US006014779A

United States Patent [19]

Lindholm

[11] Patent Number: 6,014,779

[45] Date of Patent: Jan. 18, 2000

[54] SHOWER AND BATH MAT

[76] Inventor: Venicia Lindholm, 1928 S. Sherbourne Dr. #9, Los Angeles, Calif. 90034

[21] Appl. No.: 09/044,312

[22] Filed: Mar. 19, 1998

[51] Int. Cl.[7] ..... A47K 3/02

[52] U.S. Cl. ..... 4/583

[58] Field of Search ..... 4/581, 582, 583, 4/657

[56] References Cited

U.S. PATENT DOCUMENTS

| | | | |
|---|---|---|---|
| 1,190,179 | 7/1916 | Livingston | 4/583 |
| 1,613,158 | 1/1927 | Brewer | 4/583 |
| 2,081,992 | 6/1937 | Gavlak | 4/583 |
| 2,217,821 | 10/1940 | Shiner | 4/583 |

FOREIGN PATENT DOCUMENTS

| | | | |
|---|---|---|---|
| 3303993 | 8/1984 | Germany | 4/581 |

*Primary Examiner*—Charles E. Phillips

[57] ABSTRACT

A new shower and bath mat for helping to prevent slipping on a slippery surface such as a wet bath floor surface. The inventive device includes a generally rectangular mat member having upper and lower surfaces, a pair of short sides, a pair of long sides and a plurality of corners. The upper surface of the mat member has a plurality of generally rounded nodules upwardly extending therefrom. The mat member also has a plurality of generally cylindrical apertures extending through it between its upper and lower surfaces. Located towards each corner of the mat member is a suction cup having a rounded upper portion, a lower rim, and a concavity directed from the upper portion of the suction cup towards the lower rim portion of the suction cup. The upper portion of the suction cup is upwardly extended from the upper surface of the mat member while the lower rim is downwardly extended from the lower surface of the mat member.

13 Claims, 2 Drawing Sheets

SHOWER AND BATH MAT

BACKGROUND OF THE INVENTION

1. Field of the Invention

The present invention relates to shower and bath mat and more particularly pertains to a new shower and bath mat for helping to prevent slipping on a slippery surface such as a wet bath floor surface.

2. Description of the Prior Art

The use of shower and bath mat is known in the prior art. More specifically, shower and bath mat heretofore devised and utilized are known to consist basically of familiar, expected and obvious structural configurations, notwithstanding the myriad of designs encompassed by the crowded prior art which have been developed for the fulfillment of countless objectives and requirements.

Known prior art shower and bath mat include U.S. Pat. No. 4,512,044; U.S. Pat. No. 4,167,599; U.S. Pat. No. Des. 327,388; U.S. Pat. No. 4,285,075; U.S. Pat. No. 4,625,344; and U.S. Pat. No. 5,293,660.

While these devices fulfill their respective, particular objectives and requirements, the aforementioned patents do not disclose a new shower and bath mat. The inventive device includes a generally rectangular mat member having upper and lower surfaces, a pair of short sides, a pair of long sides and a plurality of corners. The upper surface of the mat member has a plurality of generally rounded nodules upwardly extending therefrom. The mat member also has a plurality of generally cylindrical apertures extending through it between its upper and lower surfaces. Located towards each corner of the mat member is a suction cup having a rounded upper portion, a lower rim, and a concavity directed from the upper portion of the suction cup towards the lower rim portion of the suction cup. The upper portion of the suction cup is upwardly extended from the upper surface of the mat member while the lower rim is downwardly extended from the lower surface of the mat member.

In these respects, the shower and bath mat according to the present invention substantially departs from the conventional concepts and designs of the prior art, and in so doing provides an apparatus primarily developed for the purpose of helping to prevent slipping on a slippery surface such as a wet bath floor surface.

SUMMARY OF THE INVENTION

In view of the foregoing disadvantages inherent in the known types of shower and bath mat now present on the prior art, the present invention provides a new shower and bath mat construction wherein the same can be utilized for helping to prevent slipping on a slippery surface such as a wet bath floor surface.

The general purpose of the present invention, which will be described subsequently in greater detail, is to provide a new shower and bath mat apparatus and method which has many of the advantages of the shower and bath mat mentioned heretofore and many novel features that result in a new shower and bath mat which is not anticipated, rendered obvious, suggested, or even implied by any of the prior art shower and bath mat, either alone or in any combination thereof.

To attain this, the present invention generally comprises a generally rectangular mat member having upper and lower surfaces, a pair of short sides, a pair of long sides and a plurality of corners. The upper surface of the mat member has a plurality of generally rounded nodules upwardly extending therefrom. The mat member also has a plurality of generally cylindrical apertures extending through it between its upper and lower surfaces. Located towards each corner of the mat member is a suction cup having a rounded upper portion, a lower rim, and a concavity directed from the upper portion of the suction cup towards the lower rim portion of the suction cup. The upper portion of the suction cup is upwardly extended from the upper surface of the mat member while the lower rim is downwardly extended from the lower surface of the mat member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shower and bath mat apparatus and method which has many of the advantages of the shower and bath mat mentioned heretofore and many novel features that result in a new shower and bath mat which is not anticipated, rendered obvious, suggested, or even implied by any of the prior art shower and bath mat, either alone or in any combination thereof.

It is another object of the present invention to provide a new shower and bath mat which may be easily and efficiently manufactured and marketed.

It is a further object of the present invention to provide a new shower and bath mat which is of a durable and reliable construction.

An even further object of the present invention is to provide a new shower and bath mat which is susceptible of a low cost of manufacture with regard to both materials and labor, and which accordingly is then susceptible of low prices of sale to the consuming public, thereby making such shower and bath mat economically available to the buying public.

Still yet another object of the present invention is to provide a new shower and bath mat which provides in the apparatuses and methods of the prior art some of the advantages thereof, while simultaneously overcoming some of the disadvantages normally associated therewith.

Still another object of the present invention is to provide a new shower and bath mat for helping to prevent slipping on a slippery surface such as a wet bath floor surface.

Yet another object of the present invention is to provide a new shower and bath mat which includes a generally rectangular mat member having upper and lower surfaces, a pair of short sides, a pair of long sides and a plurality of corners. The upper surface of the mat member has a plurality of generally rounded nodules upwardly extending therefrom. The mat member also has a plurality of generally cylindrical apertures extending through it between its upper and lower surfaces. Located towards each corner of the mat member is a suction cup having a rounded upper portion, a lower rim, and a concavity directed from the upper portion of the suction cup towards the lower rim portion of the suction cup. The upper portion of the suction cup is upwardly extended from the upper surface of the mat member while the lower rim is downwardly extended from the lower surface of the mat member.

Still yet another object of the present invention is to provide a new shower and bath mat that has a plurality of apertures for letting water pass therethrough.

Even still another object of the present invention is to provide a new shower and bath mat that has a plurality of rounded nodules for massaging feet on it and for helping prevent slipping on the floor surface.

Even yet still another object of the present invention is to provide a new shower and bath mat that includes suction cups for holding the mat to a bath floor surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
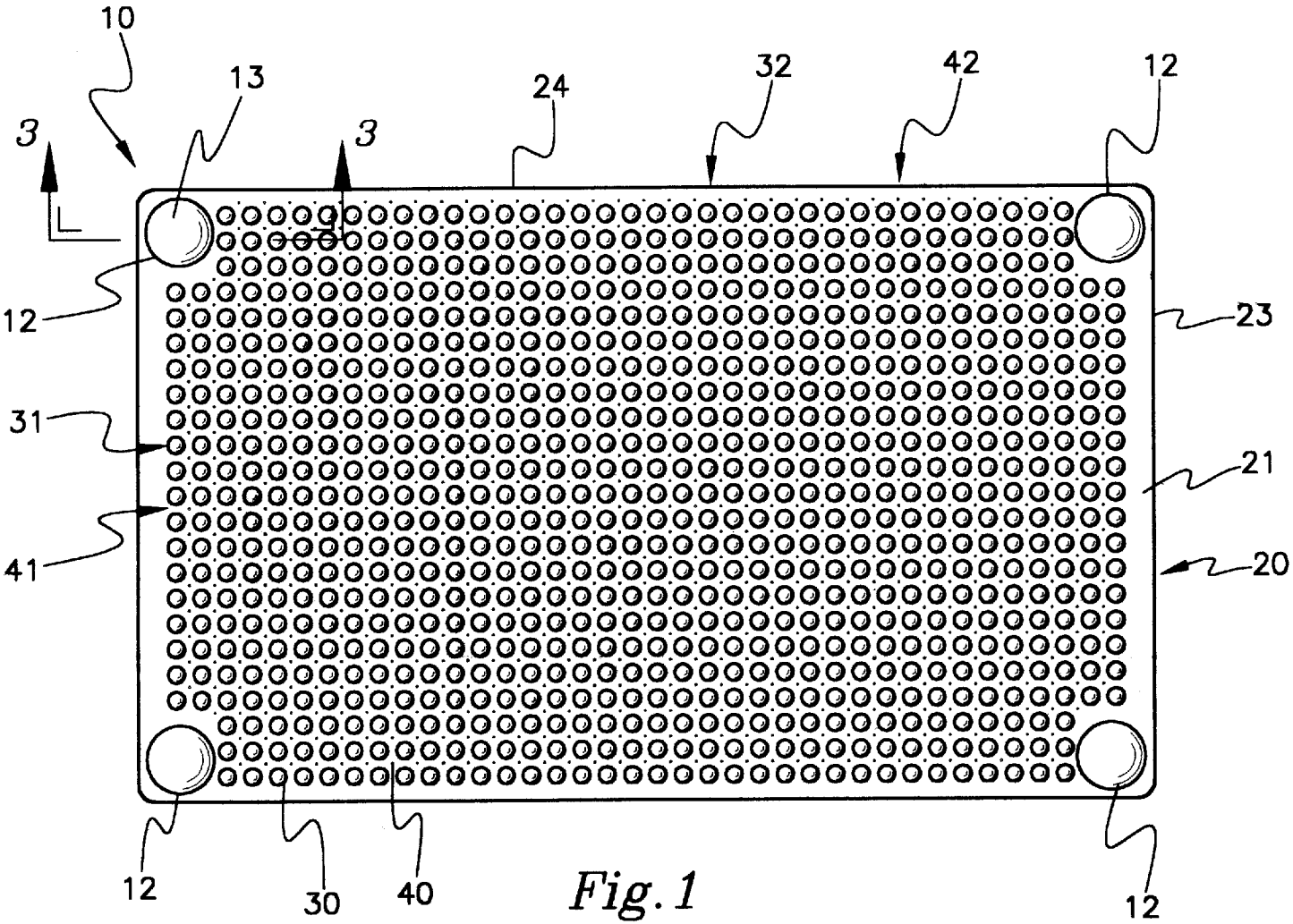
FIG. 1. is a schematic top side view of a new shower and bath mat according to the present invention.
Figure 2:
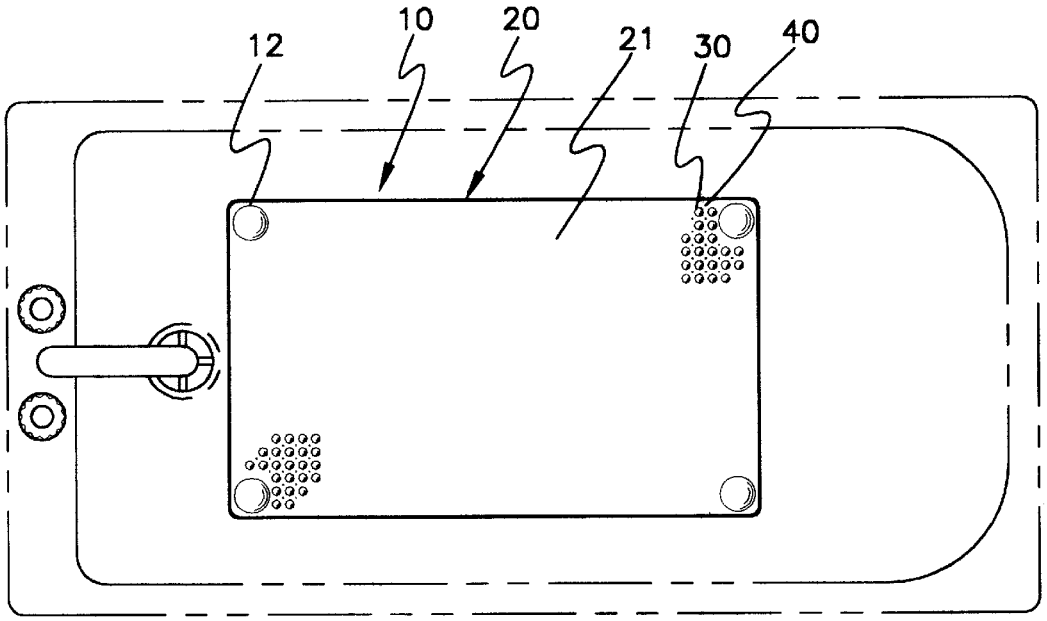
FIG. 2 is a schematic top side view of the present invention in use.
Figure 3:
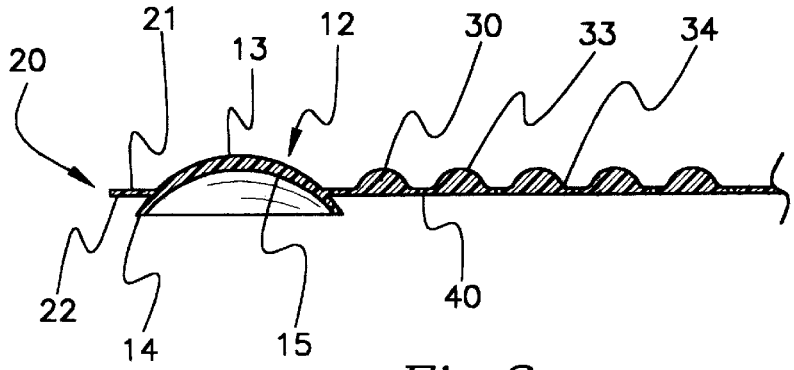
FIG. 3 is a schematic cross sectional view of the present invention taken from line 3—3 on FIG. 1.
Figure 4:
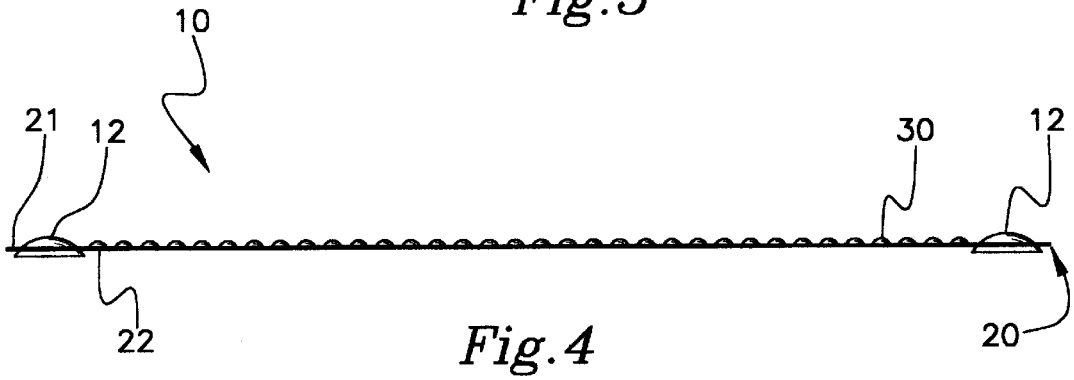
FIG. 4 is a schematic side view of the present invention.

With reference now to the drawings, and in particular to FIGS. 1 through 4 thereof, a new shower and bath mat embodying the principles and concepts of the present invention and generally designated by the reference numeral 10 will be described.

As best illustrated in FIGS. 1 through 4, the shower and bath mat 10 generally comprises a generally rectangular mat member 20 having upper and lower surfaces 21,22, a pair of short sides 23, a pair of long sides 24 and a plurality of corners. The upper surface of the mat member 20 has a plurality of generally rounded nodules 30 upwardly extending therefrom. The mat member 20 also has a plurality of generally cylindrical apertures 40 extending through it between its upper and lower surfaces 21,22. Located towards each corner of the mat member 20 is a suction cup 12 having a rounded upper portion 13, a lower rim 14, and a concavity 15 directed from the upper portion 13 of the suction cup towards the lower rim 14 portion of the suction cup. The upper portion 13 of the suction cup is upwardly extended from the upper surface of the mat member 20 while the lower rim 14 is downwardly extended from the lower surface of the mat member 20.

The shower and bath mat 10 is designed for placement on the floor surface of a shower or of a bathtub. In closer detail, the mat member 20 is generally rectangular and has upper and lower surfaces 21,22, a pair of short sides 23, a pair of long sides 24 and four corners. Preferably, the mat member 20 is flexible to help its resting on an uneven surface and to permit its rolling up for convenient storage. The lower surface 22 of the mat member 20 is generally flat and is designed for resting on a surface. In the preferred embodiment, the short sides 23 are substantially perpendicular to the long sides 24 and the corners of the mat member 20 are rounded. Ideally, the mat member 20 is constructed from rubber or plastic.

A mat length is defined between the short sides 23 of the mat member 20 and a mat width is defined between the long sides 24 of the mat member 20. Preferably, the mat width is less the mat length and greater than ½ of the mat length. Illustrative ideal dimensions of the mat member 20 include a mat length less than about 36 inches with a mat width less than about 24 inches, and a mat length less than about 30 inches with a mat width is less than about 18 inches. A mat thickness is defined between the upper and lower surfaces 21,22 of the mat member 20. Preferably, the mat thickness is less than about ⅛ inch. Ideally, the mat thickness is about 1/16 inch.

The upper surface 21 of the mat member 20 has a plurality of generally rounded nodules 30 upwardly extending from it which are designed for massaging feet on upper surface 21 of the mat member 20 and for helping preventing slipping on a floor surface. Each of the nodules 30 have a top and a root 34 with the root 34 positioned adjacent the upper surface of the mat member 20. A nodule 30 height is defined between the top of the nodules 30 and the upper surface of the mat member 20. Preferably, the nodule 30 height is less than about 3/16 inch. In the preferred embodiment, the root 34 of the nodule 30 has a diameter of less than about ½ inch.

The nodules 30 are spaced apart and arranged in a plurality of parallel columns 31 and parallel rows 32. The columns 31 of the nodules 30 are extended between the short sides 23 of the mat member 20 and the rows 32 of the nodules 30 are extended between the long sides 24 of the mat member 20. Preferably, the columns 31 of nodules 30 are generally parallel to the long sides 24 of the mat member 20 while the rows 32 of nodules 30 are generally parallel to the short sides 23 of the mat member 20 and substantially perpendicular to the columns 31 of the nodules 30.

The mat member 20 also has a plurality of generally cylindrical apertures 40 extending through it between the upper and lower surfaces 21,22 of the mat member 20. The apertures 40 are designed for permitting fluid to pass between the upper and lower surfaces 21,22 of the mate member to help prevent slipping on the upper surface of the mat member 20. Preferably, the diameter of each aperture is about 1/32 inch. The apertures 40 are spaced apart and arranged in a plurality of parallel columns 41 and parallel rows 42. Preferably, the columns 41 of apertures 40 are extended between the short sides 23 of the mat member 20 and the rows 42 of apertures 40 are extended between the long sides 24 of the mat member 20. Like the nodules 30, it is even more preferred that the columns 41 of apertures 40 be generally parallel to the long sides 24 of the mat member 20 and the rows 42 of apertures 40 be generally parallel to the short sides 23 of the mat member 20 and substantially perpendicular to the columns of the apertures 40. In the ideal embodiment of the invention, the columns 41 of apertures 40 are alternately arranged with the columns 31 of the nodules 30 between the long sides 24 of the mat member 20 and the rows 42 of apertures 40 are alternately arranged with the rows 31 of the nodules 30 between the short sides 23 of the mat member 20.

The invention also includes a plurality of suction cups 12 with each corner of the mat member 20 having one suction cup 12 located towards it. The suction cups 12 are designed for suctionally holding the mat member 20 to a surface. Each suction cup 12 has a rounded upper portion 13, a lower rim 14, and a concavity 15 which is directed from the upper portion 13 of the suction cup 12 towards the lower rim 14 portion of the suction cup. The upper portion 13 of the suction cup 12 is upwardly extended from the upper surface 21 of the mat member 20 while the lower rim 14 is downwardly extended from the lower surface 22 of the mat member 20. Preferably, diameter of the lower rims 14 of the suction cups 12 is less than about 2 inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shower and bath mat, comprising:

a mat member being generally rectangular and having upper and lower surfaces, a pair of short sides, a pair of long sides and a plurality of corners;

said upper surface of said mat member having a plurality of generally rounded nodules extending therefrom;

said mat member having a plurality of generally cylindrical apertures extending therethrough between said upper and lower surfaces of said mat member;

a plurality of suction cups, each corner of said mat member having a said suction cup located theretowards, each of said suction cups having a rounded upper portion, a lower rim, and a concavity directed from said upper portion of said suction cup towards said lower rim portion of said suction cup, said upper portion of said suction cup being extended from said upper surface of said mat member, said lower rim being extended from said lower surface of said mat member;

wherein said short sides of said mat member define a mat length therebetween; wherein said long sides of said mat member define a mat width therebetween;

wherein said mat width is less said mat length and greater than ½ of said mat length; and wherein said nodules each have a top and a root, said root being positioned adjacent said upper surface, wherein said top of said nodules and said upper surface of said mat member define a nodule height therebetween, wherein said nodule height is less than about 3/16 inch, wherein said root of said nodule has a diameter, wherein said diameter of said nodule is less than about ½ inch, wherein each said aperture has a diameter, wherein said diameter of said aperture is about 1/32 inch.

2. The shower and bath mat of claim 9, wherein said lower surface of said mat member is generally flat, and wherein said corners of said mat member are rounded.

3. The shower and bath mat of claim 1, wherein said upper and lower surfaces of said mat member define a mat thickness therebetween, wherein said mat thickness is less than about ⅛ inch.

4. The shower and bath mat of claim 3, wherein said mat thickness is about 1/16 inch.

5. The shower and bath mat of claim 1, wherein said mat length is less than about 36 inches, and wherein said mat width is less than about 24 inches.

6. The shower and bath mat of claim 5, wherein said mat length is less than about 30 inches, and wherein said mat width is less than about 18 inches.

7. The shower and bath mat of claim 1, wherein said nodules are spaced apart and being arranged in a plurality of columns and rows.

8. The shower and bath mat of claim 7, wherein said columns of said nodules are extended between said short sides of said mat member, wherein said columns of nodules are generally parallel to said long sides of said mat member, wherein said rows of said nodules are extended between said long sides of said mat member, wherein said rows of nodules are generally parallel to said short sides of said mat member and substantially perpendicular to said columns of said nodules.

9. The shower and bath mat of claim 7, said apertures are spaced apart and are arranged in a plurality of columns and rows.

10. The shower and bath mat of claim 9, wherein said columns of said apertures are extended between said short sides of said mat member, wherein said columns of apertures are generally parallel to said long sides of said mat member, wherein said rows of said apertures are extended between said long sides of said mat member, wherein said rows of apertures are generally parallel to said short sides of said mat member and substantially perpendicular to said columns of said apertures.

11. The shower and bath mat of claim 9, wherein said columns of apertures are alternately arranged with said columns of said nodules between said long sides of said mat member, wherein said rows of apertures are alternately arranged with said row of said nodules between said short sides of said mat member.

12. The shower and bath mat of claim 1, wherein each said lower rim of said suction cups has a diameter, and wherein said diameter of said lower rim is less than about 2 inches.

13. A shower and bath mat, comprising:

a mat member being generally rectangular and having upper and lower surfaces, a pair of short sides, a pair of long sides and a plurality of corners, said lower surface of said mat member being generally flat, said short sides being substantially perpendicular to said long sides, wherein said corners of said mat member are rounded;

wherein said short sides of said mat member define a mat length therebetween;

wherein said long sides of said mat member define a mat width therebetween, wherein said mat width is less said mat length and greater than ½ of said mat length;

wherein said upper and lower surfaces of said mat member define a mat thickness therebetween, wherein said mat thickness is about 1/16 inch;

said upper surface of said mat member having a plurality of generally rounded nodules extending therefrom;

wherein said nodules each have a top and a root, said root being positioned adjacent said upper surface, wherein said top of said nodules and said upper surface of said mat member define a nodule height therebetween, wherein said nodule height is less than about 3/16 inch, wherein said root of said nodule has a diameter, wherein said diameter of said nodule is less than about ½ inch;

said nodules being spaced apart and being arranged in a plurality of columns and rows, wherein said columns of said nodules are extended between said short sides of said mat member, wherein said columns of nodules are generally parallel to said long sides of said mat member, wherein said rows of said nodules are extended between said long sides of said mat member, wherein said rows of nodules are generally parallel to said short sides of said mat member and substantially perpendicular to said columns of said nodules;

said mat member having a plurality of generally cylindrical apertures extending therethrough between said upper and lower surfaces of said mat member, wherein each said aperture has a diameter, wherein said diameter of said aperture is about 1/32 inch;

said apertures being spaced apart and being arranged in a plurality of columns and rows, wherein said columns of said apertures are extended between said short sides of said mat member, wherein said columns of apertures are generally parallel to said long sides of said mat member, wherein said rows of said apertures are extended between said long sides of said mat member, wherein said rows of apertures are generally parallel to said short sides of said mat member and substantially perpendicular to said columns of said apertures;

wherein said columns of apertures are alternately arranged with said columns of said nodules between said long sides of said mat member, wherein said rows of apertures are alternately arranged with said row of said nodules between said short sides of said mat member; and a plurality of suction cups, each corner of said mat member having a said suction cup located theretowards, each of said suction cups having a rounded upper portion, a lower rim, and a concavity directed from said upper portion of said suction cup towards said lower rim portion of said suction cup, said upper portion of said suction cup being extended from said upper surface of said mat member, said lower rim being extended from said lower surface of said mat member, wherein each said lower rim of said suction cups has a diameter, wherein said diameter of said lower rim is less than about 2 inches.

* * * * *